US005568879A

United States Patent [19]

Kovathana

[11] Patent Number: 5,568,879

[45] Date of Patent: Oct. 29, 1996

[54] VERSATILE AND UNIVERSAL PAINT CAN ATTACHMENT

[76] Inventor: Narong Kovathana, 930 W. Winona Ave., #410, Chicago, Ill. 60640-3219

[21] Appl. No.: 602,496

[22] Filed: Feb. 20, 1996

Related U.S. Application Data

[63] Continuation-in-part of Ser. No. 176,108, Dec. 30, 1993, abandoned.

[51] Int. Cl.[6] ..... B65D 25/42

[52] U.S. Cl. ..... 220/697; 220/698; 220/700; 220/736

[58] Field of Search ..... 220/695–701, 220/4.03, 735, 736

[56] References Cited

U.S. PATENT DOCUMENTS

| | | | |
|---|---|---|---|
| 3,273,746 | 9/1966 | Andrews, Jr. . | |
| 3,366,272 | 1/1968 | Ballmann | 220/90 |
| 3,463,366 | 8/1969 | Spencer | 222/570 |
| 3,469,735 | 7/1969 | Burt | 220/90 |
| 3,744,671 | 7/1973 | Saunders, Jr. | 220/90 |
| 3,811,606 | 4/1974 | Higgins | 222/570 |
| 3,844,457 | 10/1974 | Smart | 222/570 |
| 3,894,650 | 7/1975 | Crump | 248/31 |
| 3,899,107 | 8/1975 | Gaal | 220/570 |
| 3,913,785 | 10/1975 | Pattershall | 220/354 |
| 4,014,465 | 3/1977 | Ritter | 222/563 |
| 4,020,968 | 5/1977 | Chiavola | 220/90 |
| 4,022,344 | 5/1977 | Roamer | 222/4 |
| 4,125,210 | 11/1978 | Embree | 222/570 |
| 4,203,537 | 5/1980 | McAlister | 222/570 |
| 4,225,064 | 7/1980 | Westcott | 222/569 |
| 4,240,568 | 11/1980 | Pool | 222/189 |
| 4,316,560 | 2/1982 | Carter | 222/567 |
| 4,369,890 | 1/1983 | Bennett | 222/85 R |
| 4,736,874 | 4/1988 | Durant | 222/570 |
| 4,907,714 | 3/1990 | Gatz | 220/90 |
| 5,012,960 | 5/1991 | Arnold | 222/570 |
| 5,137,188 | 8/1992 | Thompson | 222/570 |

*Primary Examiner*—Stephen J. Castellano

[57] ABSTRACT

A paint can attachment 10 is for use on all nominal sized paint cans and the like. It is designed to snap-fit on top of a paint can 12 to protect the lid receiving groove 20 of the paint can 12 from paint during painting. The main part of the paint can attachment 10 has the shape of an annular ring 26. Its conical inner wall 38 can receive paint can lids of various sizes. A lid-sized elastic band 52 is used to press the original lid 12 against the conical inner wall 38 to keep the contents in a useable condition. A flexible annular ledge 40 provides for its lower part 42 to sealingly engage the inner peripheral bead 16 of the paint can 12. Due to a predeterminate width of the lower part 42 of the annular ledge 40, this lower part 42 always sits on the top of the inner peripheral bead 16 of the paint can 12, even though there are variations in diameter of the opening of the paint can 12. The paint can attachment 10 also provides a spout 54 which can be used in pouring as well as to rest a paint brush 64. A spout-sized elastic band 62 is used to press the handle 68 of the paint brush 64 against the spout 54 to prevent the brush 64 from sliding or falling down. An alternate embodiment 72 uses two bored O-rings 74, 76 to replace the conical inner wall 38 of the paint can attachment 10.

10 Claims, 3 Drawing Sheets

VERSATILE AND UNIVERSAL PAINT CAN ATTACHMENT

This application is a Continuation-of-Part of Ser. No. 08/176,108 filed Dec. 30, 1993, now abandoned.

BACKGROUND—FIELD OF THE INVENTION

This invention relates to a container snap-on attachment and, more particularly, to a device for facilitating painting and pouring paint to other containers. The present invention is a simple, easy to use, inexpensive, versatile and universal device which provides all the necessary means a painter painting from a can requires.

BACKGROUND—DESCRIPTION OF THE PRIOR ART

It is well known to all painters that when painting from a can, paint gets into the lid receiving groove, dries and forms a build-up there. This occurs when a paint brush is wiped against the inner peripheral bead of the can. In addition, paint gets into the lid receiving groove when pouring paint from a paint can to other containers. Paint also tends to be spilled and run down the side of the can. A build-up of paint in the lid receiving groove is difficult to remove, and if it is not removed completely, the resealing of the lid with the lid receiving groove will not be perfect, and paint will dry up during storage as a consequence.

In addition, when painting from a can, the painter has no convenient places to rest the paint brush, except on the top of the opened paint can. Laying the paint brush across the top of the paint can causes paint to drip down the side of the paint can and get into the lid receiving groove. Paint will also be transferred to the brush handle and, eventually, to the hands of the painter.

As a result, there were many types of paint can attachments invented to solve this painting problem. For example, there were formed pouring spouts to assist in pouring, there were groove protectors to aid in restraining paint from entering the lid receiving groove, there were brush rests and brush holders. However, there was never an attachment which satisfied all the needs in such a manner that it became commercially successful or available. The reason was that most of these devices had shortcomings.

One problem with the prior art devices was that they were either difficult to be attached to the top of the paint can or difficult to remove. Many of these devices did not have easy release means so that once they were attached to the paint can, they could not simply be removed. Others required additional means or tools to attach them securely to the paint can.

An additional problem was that the prior art devices were not convenient to use for painting. The reason was that most painting jobs require not only various painting accessories to pour the paint, protect the groove, and a place to rest the paint brush, but also require a lid which can be taken off the original paint can and replaced on the painting device. The reason that this is necessary is that a painting job generally takes several hours or longer to complete. During this time the painter needs to take work breaks. Additionally, while painting, he needs to interrupt his work to do other chores like sanding, masking, etc. Every time the painter takes a break or interrupts painting for a long time, the paint in the can begins to harden. If the painter is using one of the prior art devices, he would have to take the entire device off and close the paint can with its lid to prevent solvents from evaporating. Once the device is taken off, it must be cleaned before it can be reused. Otherwise, wet paint which has gotten under the device will be transferred to the rim and lid receiving groove that the painter has been trying to keep paint from getting into in the first place. If the paint is oil based, the solvent for cleaning the device is normally expensive and inconvenient to use. Thus, the process of taking off and cleaning the device results in lost time and additional expenses. If a painter has to choose between cleaning the device many times during a painting job and cleaning the lid receiving groove and rim of the paint can once at the end of the job, the painter would normally select the latter because it is more convenient and less costly.

Another problem with the prior art devices was that they were not cost effective. Perhaps, most inventors of the prior art devices did not realize that there were two groups of painters, professional and "do-it-yourself" or "week-end" painters. The latter group of painters are considered to be very vital to the commercializing of the devices because they are the majority of the painters. However, they paint extremely infrequently and have very small painting work like painting their houses or furniture to do. Once they are finished with their work, they will not have to paint again for many years. Therefore, to be cost effective in the paint environment, the convenience and benefits from using the device in one painting job must be worth more than the cost of the device. If the cost of the device approaches the cost of a can of paint, they would be very hesitant to purchase and use it because it is too expensive, and without it they can pour paint and do their painting work, but they will inevitably incur some spillage, inconvenience and wasted time, nevertheless.

Yet another reason that the prior art devices were not readily accepted was that most of them were not universal in their application. The attachments did not fit to the rims of all paint cans of a nominal size which vary in the outside diameters. Furthermore, they did not provide for adjustment such that the lid receiving grooves would be protected on all of these various sized cans. The ones that could be used in the same nominal sized cans but with different diameters were not versatile. They had limited features which could not satisfy all the painting needs. Also, most of the prior art devices did not provide for receiving the paint can lid on the attachment to close the can during painting breaks or interruptions. If a closing mean was provided in the prior art devices, it did not or could not receive the original paint can lids of different diameters from the same nominal sized cans onto the attachment to close the can.

Thus, it is an object of the present invention to provide a paint can attachment which is inexpensive, easy to use, and has the features of pouring spout, paint can groove protector, brush rest and holder, and is adapted to receive the top of the paint can to cover the can during painting breaks or interruptions. A related object is to provide a paint can attachment which can fit onto the rims of paint cans having different diameters but the same nominal size.

Yet another object is the object of providing a paint can attachment which can easily be removed from the paint can for cleaning and reuse. Still another object is the object of providing a paint can attachment having all of the above features provided in such a manner that the features do not interfere with the operations or functions of each other.

SUMMARY OF THE INVENTION

In accordance with the present invention, the versatile and universal paint can attachment is provided for a resealable can having a press-on lid with a sealing rib which is engageable with a lid receiving groove. The receiving groove which encircles the opening of the can is between the inner and outer peripheral connecting beads.

The attachment is manufactured as a single unit by injection molding a suitable plastic like polypropylene or nylon. It comprises an annular ring which has downwardly projecting flanges or legs with attaching means for a snap-fit engagement with the outer peripheral connecting bead of the can. The top part of the annular ring has the inner diameter larger than the diameter of a paint can lid. On the upper surface of the annular ring, there are rectangular notches and a parabolic recess. At the middle part of the annular ring, a portion of the inner wall is conical. The conical inner wall can receive various diameter lids to close the can during painting breaks or interruptions.

Below the notches and on the outer wall of the annular ring two narrow flanges extend downwardly and are diametrically opposite with one another to form ears. These ears have clipping areas to hold both ends of a stretched, lid-sized elastic band to press a paint can lid against the conical inner wall of the annular ring for a tight closure.

Below the conical inner wall, annular ledge extends from and around the inner wall of the annular ring to cover the lid receiving groove. The annular ledge also is bevelled to allow paint and the like to drain into the interior of the can. This annular ledge is resilient and vertically flexible. From and below the inner edge of the annular ledge, a lower part of the annular ledge protrudes downwardly and beyond the lower surface of the annular ring. When the attachment is in use, this part of the annular ledge firmly sits on the top of the inner peripheral bead, while the lower surface of the annular ring does not reach that of the outer peripheral bead, leaving a gap in between them. This gap is for inserting a prying tool like a screw driver to release or remove the attachment from the top of the can. Moreover, the seating of the lower part of the annular ledge on the inner peripheral bead provides the sealing necessary for preventing paint from entering into the receiving groove. Due to the lower part of the annular ledge being predeterminately wide, this part of the annular ledge always sits on the inner peripheral bead of any can of the same nominal size. Thus, the attachment is universal and can be used on all nominal sized cans regardless of diametrical tolerance.

From the outside wall and at the parabolic recess of the top part of the annular ring, a spout, which has the shape similar to the bill of a baseball cap, extends outwardly and slightly upwardly to aid in pouring and also to receive the handle of a paint brush with its bristles extending over the circular opening of the can. At about the last part and on the opposite edges of the pouring spout, two short and small flanges with lateral lips erect up to act as supports. They are used to attach a spout-sized elastic band to press the handle of a paint brush against the spout whereby the paint brush can be left securely on the can when being moved to different painting locations.

According to an alternate embodiment, the conical inner wall of the annular ring of the preferred embodiment is replaced by two bored O-rings which are disposed one above the other. They are made of plastic and integrally molded with the inner wall of the annular ring. Because they are resilient, they can accommodate various diameter paint can lids.

In the alternate embodiment, the ears to hold the lid-sized elastic band are not required because the paint can lid is frictionally retained by the bored O-rings.

DESCRIPTION OF THE PREFERRED EMBODIMENT

Figure 1:
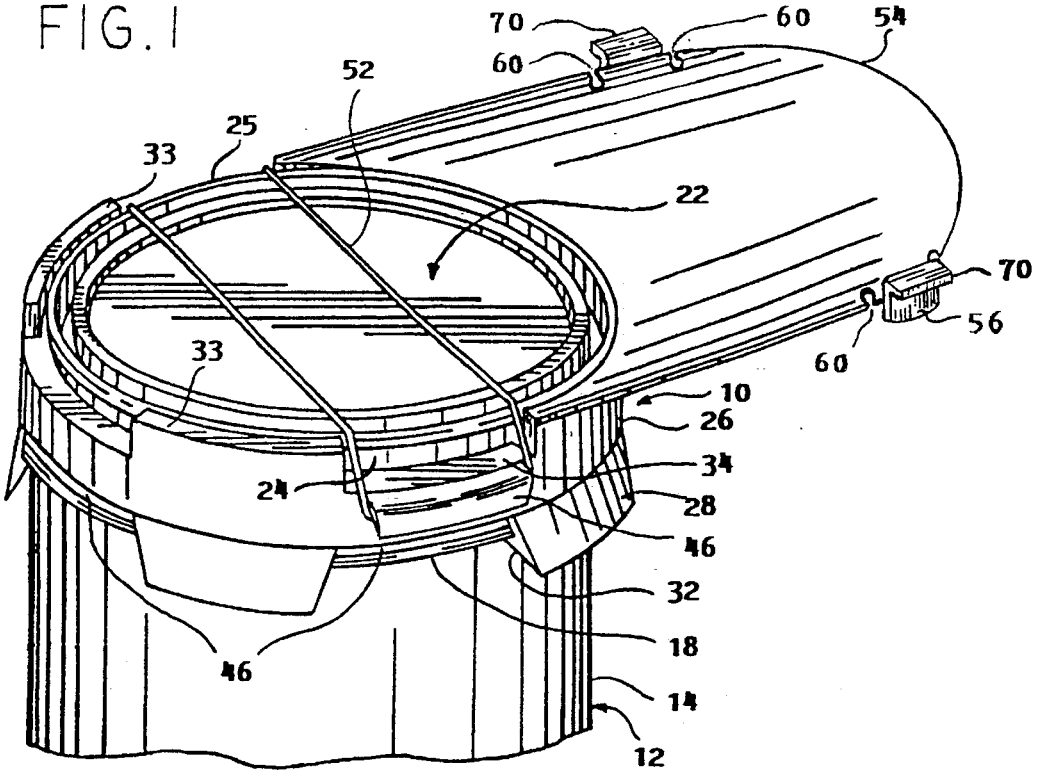
FIG. 1 is a perspective view of the inventive attachment showing how it is attached onto a paint can, and an original paint can lid is used to close the paint can with the help of a lid-sized elastic band.
Figure 2:
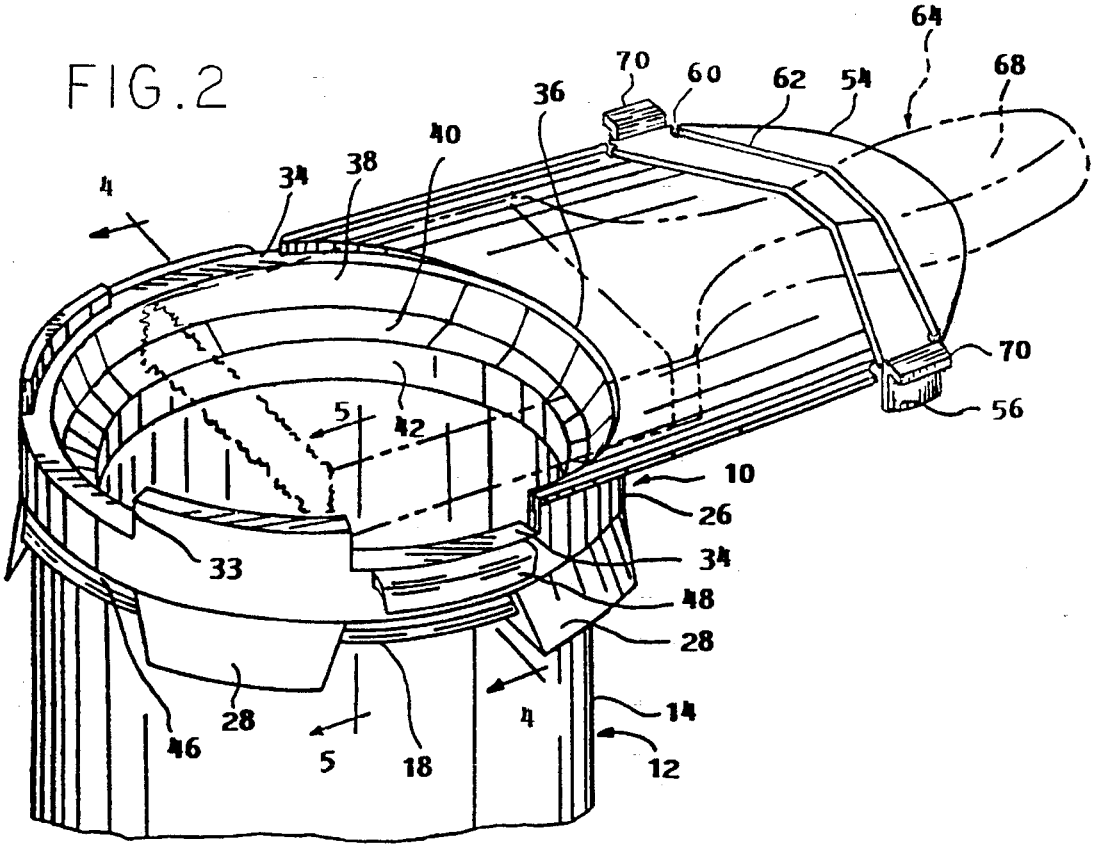
FIG. 2 is a perspective view of the inventive attachment similar to FIG. 1 but without a paint can lid showing how a paint brush is held onto the spout with the help of a spout-sized elastic band.

Turning to FIGS. 1 and 2, there is illustrated the inventive paint can attachment 10 which is adapted for mounting on a paint can 12 having an outer cylindrical side wall 14. The paint can 12 has a top end or rim and bottom end (not illustrated). The top configuration of the paint can 12 is more clearly shown in the sectional view of FIG. 5. At the top end, there is an outer peripheral bead 18 which encompasses the outer periphery of the top of the paint can 12, and an inner peripheral bead 16 which defines a circular opening in the paint can 12 through which its contents are poured. A lid receiving groove 20 is disposed between the inner and outer peripheral beads, 16, 18. A paint can lid 22 is of the type being a press-on lid having a sealing rib 24 and a lip 25. The sealing rib 24 engages the receiving groove 20 to seal the contents within the paint can 12.

Viewing the attachment 10 in FIGS. 1, 2, 3, 4 and 5, there is seen an annular ring 26 whose outer diameter is slightly larger than the outer diameter of the largest paint can 12 measured across the outer edges of the outer peripheral bead 18. From a survey of paint cans from 45 different manufacturers, it was found to be 4.28125 inches (10.874375 cm.) and 6.6250 inches (16.8275 cm.) for quart (946.35 ml.) or gallon (3,785.41 ml.) sized cans, respectively. The inner diameter of the annular ring 26 is slightly smaller than the outer diameter of the paint can 12. From the lower surface and along the outer circumference of the annular ring 26, a plurality of thin flexible curved flanges, whose outer and inner horizontal contours are parts of circles, protrude downwardly and outwardly to form legs each indicated as 28. These curved flanges also are sufficiently wide to cover most part of the rim of the can 12 when the attachment 10 is in use. At about one third of the length of legs 28, the inner walls of the legs 28 extend downwardly toward the center of the annular ring 26. The downward extending of the inner walls continues to about the middle part of the legs 28 to form locking shoulders each indicated as 30. The spaces measured across the lower edges of the locking shoulders 30 must be slightly smaller than the outer diameter of the smallest paint can 12 measured across the outer edges of the outer peripheral bead 18. It was found to be 4.25 inches (10.795 cm.) or 6.5625 inches (16.66875 cm.) for quart or gallon sized cans, respectively.

From the lower edges of the locking shoulders 30, the inner walls extend downwardly away from the center of the annular ring 26 and end at the tips of the legs 28, forming tapering inner walls each indicated as 32. Since the downward extending of the inner walls of legs 28 is uniform through out the entire walls, and their inner horizontal contours are parts of a circle to begin with, any horizontal line on the inner walls of the legs 28 is a part of a circle as more clearly shown in FIG. 3. The resulting round horizontal inner contours of the legs 28 are to facilitate in attaching the attachment 10 onto the round top of the paint can 12. Furthermore, because the legs 28 extend outwardly, the spaces between them at their tips are larger than the outer diameter of any paint can of the same nominal size. This makes attaching of the attachment 10 very easy. One simply places the attachment 10 having its legs 28 sitting on the top of an opened paint can 12 and pushes it down. Due to the inner walls 32 of the legs 28 being tapering upwardly from their tips, and the spaces between the legs 28 at the edges of the locking shoulders 30 are designed to be smaller than the outer diameter of any paint can, the legs 28 are gradually pushed over by the outer peripheral bead 18 of the paint can 12. When the attachment is pushed down further, the locking shoulders 30 will go past the edges of the outer peripheral bead 18, the locking shoulders 30 will snap around the outer peripheral bead 18, causing the attachment 10 to be retained in snap-fit engagement with the bead 18.

Also looking at FIGS. 1, 2, 4 and 5, there is illustrated the top part 33 of the annular ring 26. Its diameter must be slightly larger than the diameter of the largest paint can lid 22 measured across the outer edges of its lip 25. From the same survey, it was found to be 3.9375 inches (10.00125 cm.) or 6.1875 inches (15.71625 cm.) for lids from quart or gallon sized cans, respectively. A plurality of rectangular notches each indicated as 34 and a parabolic recess 36 are placed on the top surface of the annular ring 26. The notches 34 are places for inserting a prying tool like a screw driver to engage the lip 25 and pry the lid 22 off, if the paint can 12 is closed by having its lid 22 engaged on the top of the attachment 10. In addition, the notches 34 are also places for fingers to reach and grasp the lid 22 out from the top of the attachment 10.

Just below the top part 33 of the annular ring 26 is the middle part of the annular ring 10. The inner diameter of the beginning of this part of the wall must be slightly larger than the diameter of the largest lid 22 measured across the outer edges of its sealing rib 24. It was found to be 3.875 inches (9.8425 cm.) or 6.125 inches (15.5575 cm.) for lids from quart or gallon sized cans, respectively. At this point, its inner wall inclines downwardly toward the center of the ring 26. It extends from and around the inner circumference of the annular ring 26 to form a portion of the inner wall as a inner conical wall 38 of a height approximately equal to the height of the shortest rib 24 of a paint can lid 22 found in the survey. It was 0.1875 inch (0.47625 cm.) or 0.25 inch (0.635 cm.) for lids from quart or gallon sized cans, respectively. Additionally, the diameter of the bottom of the conical wall 38 must be slightly smaller than the diameter of the smallest lid 22 measured across the outer edges of its sealing rib 24. It was found to be 3.6875 inches (9.36625 cm.) or 6.0625 inches (15.39875 cm.) for lids from quart or gallon sized cans, respectively. It is designed such that any paint dripping on it will drain into the interior of the paint can 12. Furthermore, the conical inner wall 38 is adapted to receive a paint can lid 22 for closing the paint can 12. Because the diameter of the attachment 10 around the conical inner wall 38 is large at the top and small at the bottom, various diameter lids can be used to close the paint can 12 whereby the rib 24 of a larger lid 22 will engage with the conical inner wall 38 at the top, and that of the smaller one will fit to the bottom of the conical inner wall 38.

A thin annular ledge 40 connects to the lower part of the conical inner wall 38. It is vertically flexible and extends from and around the inner wall of the annular ring 26 to cover the lid receiving groove 20. Extending downwardly from the interior-most edge of the annular ledge 40 and beyond the lower surface of the annular ring 26 is a lower part 42 of the annular ledge 40. The end of this part of the annular ledge 40 has a curved bottom 44. The diameter measured across two highest points of the curves under the curved bottom 44 of the lower part 42 of the annular ledge 40 must be equal to the average of the diameters of the largest and smallest paint can openings measured across the top edges of the inner peripheral beads 16 in the survey. It was 3.40625 inches (8.651875 cm.) or 5.625 inches (14.2875 cm.) for quart or gallon sized cans, respectively. The width of the lower part 42 of the annular ledge 40 must be more than half of the difference between the diameters of the largest and smallest paint can openings measured across the top edges of the inner peripheral bead 16. It was 0.15625 inch (0.396875 cm.) or 0.0625 inch (0.15875 cm.) for quart or gallon sized cans, respectively. Furthermore, when the attachment 10 is attached to the paint can 12, the curved bottom 44 firmly sits onto the top of the inner peripheral bead 16, while the lower surface of the annular ring 26 does not reach the top of the outer peripheral bead 18, leaving a gap 46 in between them. This gap 46 is for inserting a prying tool like a screw driver to remove the attachment 10 from the paint can 12.

Due to the annular ledge 40 being flexible, the lower part 42 of the annular ledge 40 is designed to be longer than the distance required for it to reach the top of the inner peripheral bead 16 when the attachment 10 is in snap-fit engagement with the can 12, and the locking shoulders 30 snap around the outer peripheral bead 18. This is to ensure that the lower part 42 of the annular ledge 40 will always get to the top of the inner peripheral bead 16, even though there is some variations in size of the outer peripheral bead 18. When the lower part 42 of the annular ledge 40 is longer than the required length, in attaching the attachment 10 onto the top of the can 12, it has to be pushed down. In this process, the curved bottom 44 is pressed against the top of the inner peripheral bead 16, and the annular ledge 40 is flexing up as the remaining of the attachment 10 is being pushed down. When the attachment 10 is pushed down farther, the locking shoulders 30 will go past the lower edges of the outer peripheral bead 18 and snap around it. Moreover, as the annular ledge 40 flexes up, it also exerts a downward force onto its lower part 42, resulting in a pressure applied against the inner peripheral bead 16. Consequently, the curved bottom 44 of the lower part 42 of the annular ledge 40 seals the annular ring 26 against the bead 16 and prevents paint from entering into the receiving groove 20. Furthermore, due to the lower part 42 of the annular ledge 40 being predeterminately wide, the curved bottom 44 always sits on the top of the bead 16 of any can of the same nominal size regardless of variations in the interior opening of the paint can 12.

Also as seen in FIGS. 1, 2, 3, and 4, below the notches 34 are a pair of generally narrow flanges which are mounted diametrically opposite to each other with their longer ends being generally parallel to the bottom surfaces of the notches 34. Their opposite ends extend outwardly from the annular ring 26 and curve downwardly until they almost reach the lower edges of the annular ring 26 to form ears each indicated as 48. Behind the ears 48, there are cavities which are used as clipping areas each indicated as 50. The clipping areas 50 are for holding both ends of a lid-sized elastic band 52 as more clearly shown in FIG. 1. The cavities or clipping areas 50 are designed to be about as wide as the size of the elastic band 52 at the openings and to be narrower at the bottoms. This is for retaining one end of the elastic band 52 within the clipping area 50 and preventing the elastic band 52 from getting lost, when one end of the elastic band 52 is released from the clipping area 50, and the elastic band 52 is not being used to press the lid 22 to close the paint can 12. Additionally, the two narrow flanges are sufficiently long so that the clipping areas 50 formed under them along the outer wall of the annular ring 26 will also long enough to spread both strings of the elastic band 52 so apart that when the lid 22 is put under it, every part of the lid 22 will receive an even pressure from it.

With the paint can lid 26 placed on top of the conical inner wall 38, an elastic band 52 is placed within the clipping area 50 of one ear 48, turned up, around and over the paint can lid 22 and placed into the clipping area 50 of the other ear 48. This provides an inexpensive and simple securing mechanism to press the paint can lid 22 onto the conical inner wall 38 of the annular ring 26 during painting breaks or interruptions.

Figure 3:
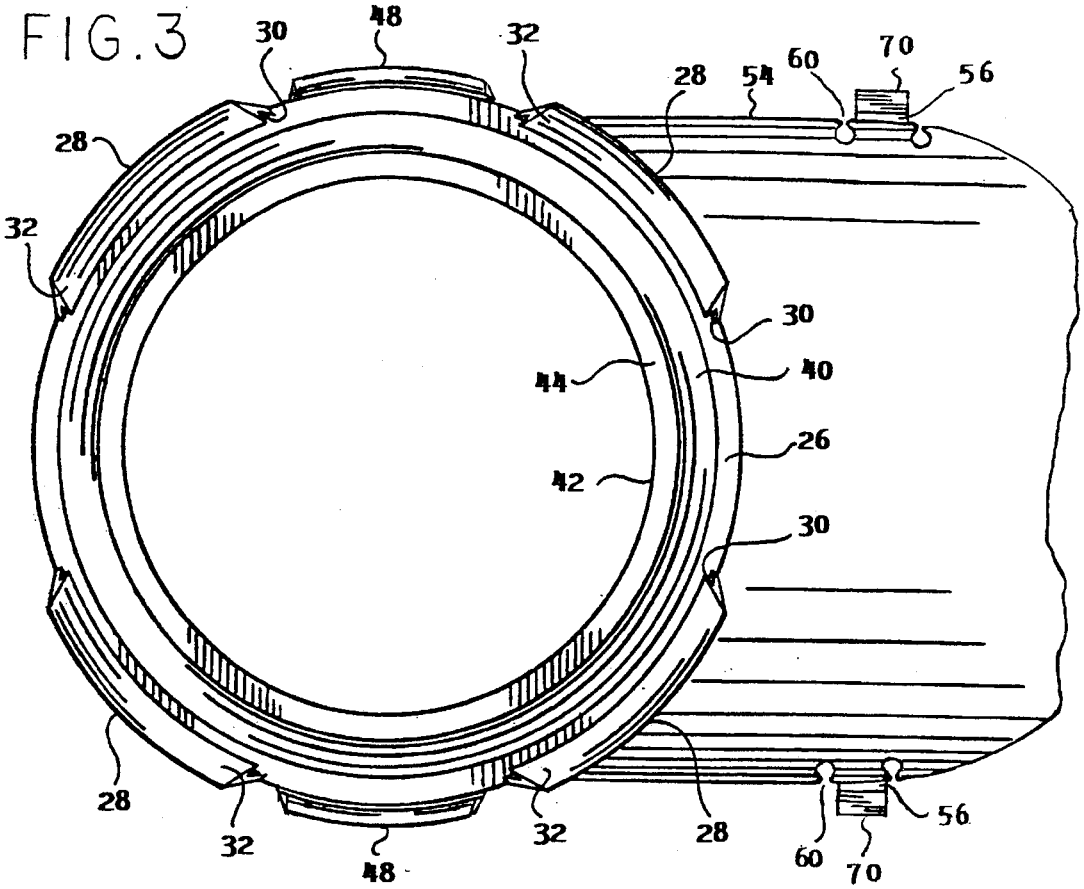
FIG. 3 is a bottom plan view of the inventive attachment.
Figure 4:
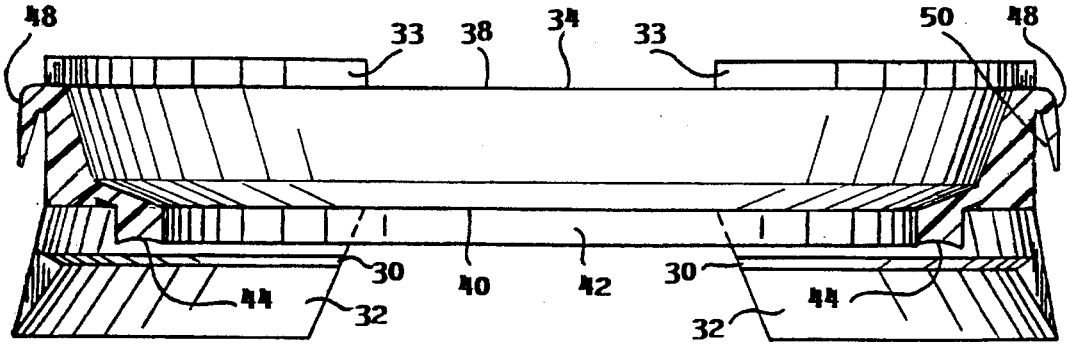
FIG. 4 is a cross-sectional view taken along line 4—4 of FIG. 2 but without showing a paint brush.

Also as seen in FIGS. 1, 2 and 3, there is provided a pouring spout 54 which extends outwardly from the outside wall and at the parabolic recess 36 of the top surface of the annular ring 26. The spout 54 is similar to the inverted bill of a baseball cap with any paint or dripping being directed toward the center of the spout 54. Also, the spout 54 is angled slightly upwardly so that paint will drip back into the paint can 12. About at the end and on the opposite edges of the spout 54, a pair of short flanges of a suitable size erect up and protrude downwardly to act as supports each indicated as 56. Next to both sides of each support 56 and on the lateral edges of the pouring spout 54, there are two shallow cavities of about the size of a spout-sized elastic band 62. The openings of these cavities are at the outer edges of the pouring spout 54. They are used as clipping areas each indicated as 60. The clipping areas 60 are wide at the openings, narrow in the middles and become wider at the bottoms. The purpose of variations in size at different parts of these clipping areas 60 is to facilitate in putting an elastic band 62 into these clipping areas 60, to retain the elastic band 62 once it is slipped down to the bottoms of the clipping areas 60, and to allow the elastic band 62 to regain its original size. This design prevents the elastic band 62 from slipping out by itself and getting lost, as one end is loose, and the elastic band 62 is not being used to secure a paint brush 64.

When both ends of the elastic band 62 are secured to the clipping areas 60 of both sides of the pouring spout 54, it is stretched up. If the handle 68 of a paint brush 64 is put under it, as specifically shown in FIG. 2, the brush 64 will be held in a semi-secured position and will not slide or fall down when the paint can 12 is being moved. The brush 64 will have its bristles extending down over the opening of the paint can 12 such that paint will drip into the can 12.

The supports 56 also have lips each indicated as 70 on their lateral top edges. These lips 70 are to prevent the elastic band 62 from slipping out from the supports 56 when it is stretched across the pouring spout 54 and placed under these lips 70. Consequently, they allows for some convenience in securing and removing the paint brush 64 by having to put only one end of the elastic band 62 into the clipping area 60. In securing the paint brush 64, after an end of the elastic band 62 is put into the clipping areas 60 on one side of the pouring spout 54, one simply pulls across the free end of the elastic band 62 over the paint brush handle 68, loops it around the support 56 and places it under the lip 70. In removing the paint brush 64, one simply pulls the elastic band 62 clear from the lip 70 and over the support 56, lets go the elastic band 62 and takes off the paint brush 64.

Figure 6:
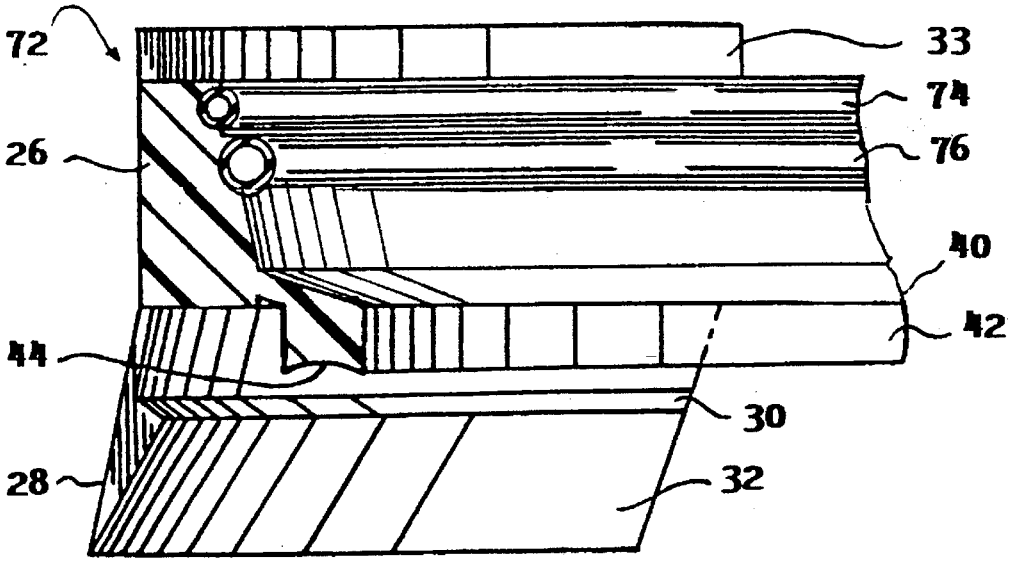
FIG. 6 is similar to FIG. 5 but without a paint can showing an alternate embodiment of the inventive attachment utilizing two O-rings to retain a paint can lid.

Turning to FIG. 6, an alternate embodiment of an attachment 72 is illustrated. The difference between this attachment 72 and the preferred attachment 10 is that there are provided two bored O-rings 74, 76 which are disposed one above the other and attached around the inner wall and below the top part 33 of the annular ring 26. In addition, the vertical distance between the upper peripheral edges of the bored O-ring 74 and the center of the bored O-ring 76 must be slightly smaller than the height of the shortest sealing rib 24. (The heights of the shortest sealing ribs 24 of lids 22 for both can sizes have already been included in the description of the preferred embodiment.) This allows for the sealing ribs 24 of smaller lids 22 to reach the middle of the bored O-ring 76 and to be retained by it. The bored O-rings 74, 76 are made of plastic and integrally molded with the inner wall of the annular ring 26. They replace and serve the same function as the conical inner wall 38 of the attachment 10. i.e., the bored O-rings 74, 76 provide a mean by which the outer peripheral edges of the sealing rib 24 can be seated within and sealed against the annular ring 26. As the bored O-rings 74, 76 are resilient and flexible, they can accommodate various diameter paint can lids 22.

As illustrated in FIG. 6, the top bored O-ring 74 is seated deeper into the inner wall of the annular ring 26 and, consequently, the diameter of the inner wall measured across this O-ring 74 is large and must be as large as the diameter of the largest paint can lid 22 measured across the outer edges of its sealing rib 24, when the bored O-ring 74 is fully depressed. This part of the inner wall is designed to accommodate large paint can lids 22. In contrast, the bottom bored O-ring 76 is larger and not seated as deep as the top one. As a result, the diameter of the inner wall across this O-ring 76 is smaller and must be slightly smaller than the diameter of the smallest lid 22 measured across the outer edges of its sealing rib 24, when the bored O-ring 76 is fully extended. This part of the inner wall is for accommodating smaller paint can lids 22. With this combination of two different diameters of the inner wall measured across the O-rings 74, 76 and the resiliency of both O-rings 74, 76, most, if not all, lids of various sizes can be used to close the paint can 12. Furthermore, because the paint can lid 22 is frictionally retained by one of the bored O-ring 74, 76 when it closes the can, the ears 48 and the elastic band 52 are not required in the attachment 72.

With this slight difference, the alternate embodiment attachments 72 work substantially identically to the attachment 10 described in the preferred embodiment.

Thus, there has been provided in accordance with the invention, a paint can attachment that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A paint can attachment for a paint can, said paint can having a generally right-circular-cylindrical side wall, a generally circular paint can top attached to said paint can side wall at the uppermost right section of said paint can side wall, a paint can bottom attached to said paint can side wall across the lowermost right section of said paint can side wall, and an original paint can lid removably attached to said paint can top ending at an inner radius less than an outer radius of said paint can side wall, said paint can top having an outer peripheral bead around said outer radius and an inner peripheral bead around said inner radius, said paint can holding paint, and when said original paint can lid is removed, paint can be taken out from said paint can, said paint can attachment comprising:

an annular ring which can be removably attached to said paint can, said annular ring having an outer wall which is generally concentric with said paint can side wall, said annular ring having an inner wall generally concentric with said annular ring outer wall;

a generally conical portion of said annular ring inner wall, said conical portion having an inner radius less than said original paint can lid outer radius, said conical portion for receiving and supporting said original paint can lid when said original paint can lid is removably disposed on said conical portion;

an annular ledge developing a generally circular, downward and radially inward, lowest portion of said annular ring inner wall, said annular ledge extending to a smallest radius less than said paint can top inner radius, said annular ledge having an annular ledge bottom extending radially outward from said smallest radius, said annular ledge bottom for removably sealing said annular ring against said inner peripheral bead when said annular ring is removably attached to said paint can, said annular ledge being resilient and able to adjust to make a sealing contact with said inner peripheral bead when said annular ring is removably attached to said paint can, said annular ledge bottom having a wide sealing surface so that said annular ledge bottom can adjust to size variations of said paint can top to make a sealing contact with said inner peripheral bead; and a pouring spout connected to said annular ring, said pouring spout for pouring paint from said paint can.

2. The paint can attachment of claim 1 further comprising a spout-sized elastic band, said spout-sized elastic band removably attached to said pouring spout, so that said spout-sized elastic band can be stretched across said pouring spout and across a paint brush, while said paint brush is removably disposed on said pouring spout, for causing a frictional force removably securing said paint brush on said pouring spout.

3. The paint can attachment of claim 1 further comprising means for removably attaching a spout-sized elastic band to said pouring spout.

4. The paint can attachment of claim 3 wherein said means for removably attaching a spout-sized elastic band to said pouring spout comprises supports attached to said pouring spout.

5. The paint can attachment of claim 1 further comprising a lid-sized elastic band, said lid-sized elastic band removably attached to said annular ring, so that said lid-sized elastic band can be stretched across said original paint can lid, while said original paint can lid is removably disposed on said conical portion, for causing a force which removably and sealingly presses said original paint can lid against said conical portion.

6. The paint can attachment of claim 1 further comprising means for holding a lid-sized elastic band to said annular ring.

7. The attachment of claim 6 wherein said means for holding a lid-sized elastic band to said annular ring comprises ears attached to said annular ring.

8. A paint can attachment for a paint can, said paint can having a generally right-circular-cylindrical side wall, a generally circular paint can top attached to said paint can side wall at the uppermost right section of said paint can side wall, a paint can bottom attached to said paint can side wall across the lowermost right section of said paint can side wall, and an original paint can lid removably attached to said paint can top ending at an inner radius less than an outer radius of said paint can side wall, said paint can top having an outer peripheral bead around said outer radius and an inner peripheral bead around said inner radius, said paint can holding paint, and when said original paint can lid is removed, paint can be taken out from said paint can, said paint can attachment comprising:

an annular ring which can be removably attached to said paint can, said annular ring having an outer wall which is generally concentric with said paint can side wall, said annular ring having an inner wall generally concentric with said annular ring outer wall;

a generally circular, resilient protrusion from said annular ring inner wall, said resilient protrusion for removably and sealingly pressing said annular ring against a circumference of said original paint can lid;

an annular ledge developing a generally circular, downward and radially inward, lowest portion of said annular ring inner wall, said annular ledge extending to a smallest radius less than said paint can top inner radius, said annular ledge having an annular ledge bottom extending radially outward from said smallest radius, said annular ledge bottom for removably sealing said annular ring against said inner peripheral bead when said annular ring is removably attached to said paint can, said annular ledge being resilient and able to adjust to make a sealing contact with said inner peripheral bead when said annular ring is removably attached to said paint can, said annular ledge bottom having a wide sealing surface so that said annular ledge bottom can adjust to size variations of said paint can top to make a sealing contact with said inner peripheral bead;

a pouring spout connected to said annular ring, said pouring spout for pouring paint from said paint can; and a spout-sized elastic band, said spout-sized elastic band removably attached to said pouring spout, so that said spout-sized elastic band can be stretched across said pouring spout and across a paint brush, while said paint brush is removably disposed on said pouring spout, for causing a frictional force removably securing said paint brush on said pouring spout.

9. The paint can attachment of 8 further comprising means for removably attaching said spout-sized elastic band to said pouring spout.

10. The paint can attachment of 9 wherein said means for removably attaching said spout-sized elastic band to said pouring spout comprises supports attached to said pouring spout.

* * * * *

UNITED STATES PATENT AND TRADEMARK OFFICE

CERTIFICATE OF CORRECTION

PATENT NO. : 5,568,879
DATED : October 29, 1996
INVENTOR(S) : Narong Kovathana

Figure 5:
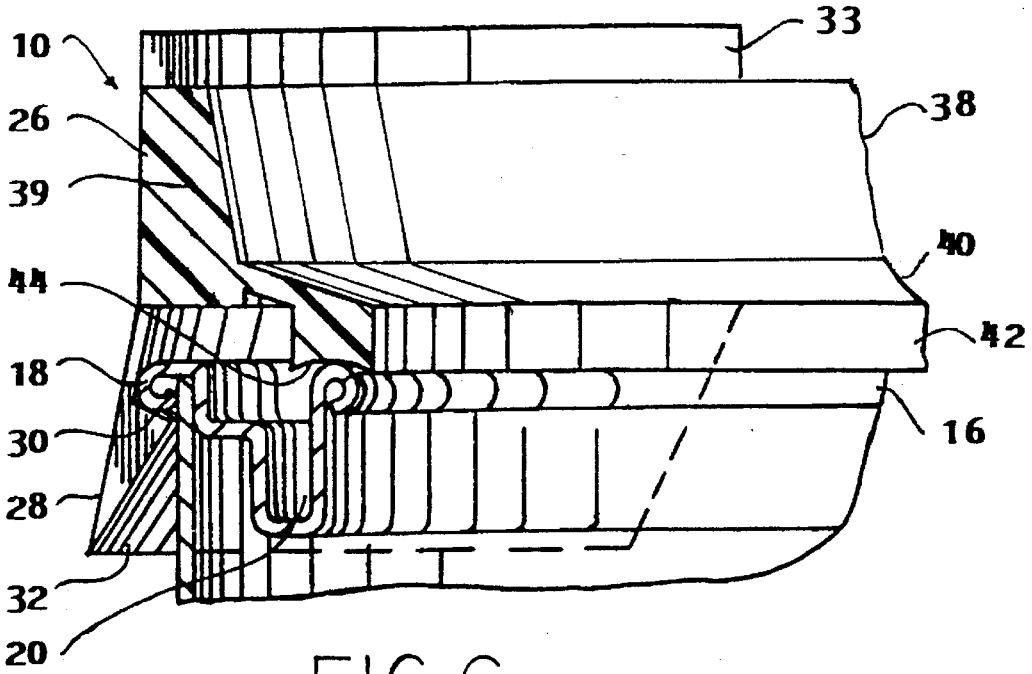
FIG. 5 is an enlarged fragmentary sectional view taken generally along line 5—5 of FIG. 2 showing its attaching and sealing mechanisms.

It is certified that error appears in the above-indentified patent and that said Letters Patent is hereby corrected as shown below:

On sheet 3, Fig. 5 of the drawings, delete "39."
Col. 6, line 38, change "is" to "--are--."
Col. 7, line 17, change "26" to "--22--."
Col. 8, line 52, change "attachments" to "--attachment--."

Signed and Sealed this

Eighth Day of April, 1997

Bruce Lehman

*Attest:*

BRUCE LEHMAN

*Attesting Officer*

*Commissioner of Patents and Trademarks*